US007635127B2

(12) United States Patent
Kuse

(10) Patent No.: US 7,635,127 B2
(45) Date of Patent: Dec. 22, 2009

(54) SHEET FEEDING APPARATUS

(75) Inventor: Kazutoshi Kuse, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 89 days.

(21) Appl. No.: 11/768,237

(22) Filed: Jun. 26, 2007

(65) Prior Publication Data

US 2008/0006985 A1 Jan. 10, 2008

(30) Foreign Application Priority Data

Jun. 26, 2006 (JP) ..... 2006-175665

(51) Int. Cl.
*B65H 7/08* (2006.01)

(52) U.S. Cl. ..... 271/110; 271/10.01; 271/10.03; 271/10.09; 271/114

(58) Field of Classification Search ..... 271/10.01, 271/10.03, 10.09, 110, 114
See application file for complete search history.

(56) References Cited

U.S. PATENT DOCUMENTS

| | | | | |
|---|---|---|---|---|
| 5,495,326 | A * | 2/1996 | Mikida | 399/43 |
| 5,924,686 | A * | 7/1999 | Jacobson et al. | 271/3.17 |
| 6,199,854 | B1 * | 3/2001 | Tranquilla et al. | 271/34 |
| 6,227,534 | B1 * | 5/2001 | Schoedinger et al. | 271/114 |
| 6,533,264 | B1 * | 3/2003 | Tranquilla | 271/10.02 |
| 6,655,677 | B2 * | 12/2003 | Marshall et al. | 271/10.03 |
| 6,729,613 | B2 * | 5/2004 | Marra et al. | 271/10.02 |
| 6,786,481 | B2 * | 9/2004 | Kawai et al. | 271/109 |
| 7,275,740 | B2 * | 10/2007 | Able et al. | 271/10.01 |
| 2001/0022422 | A1 * | 9/2001 | Tamura | 271/10.03 |
| 2002/0079637 | A1 * | 6/2002 | Skadow et al. | 271/10.01 |
| 2004/0207887 | A1 | 10/2004 | Makino et al. | |
| 2008/0237969 | A1 * | 10/2008 | Totsuka et al. | 271/109 |

FOREIGN PATENT DOCUMENTS

| | | |
|---|---|---|
| JP | 03-031128 | 2/1991 |
| JP | 05-116810 | 5/1993 |
| JP | 8319037 | 12/1996 |
| JP | 8337333 | 12/1996 |
| JP | 11341246 | 12/1999 |
| JP | 2001302017 | 10/2001 |
| JP | 2002236739 | 8/2002 |
| JP | 2004225201 | 8/2004 |
| JP | 2004297780 | 10/2004 |
| JP | 2005098117 | 4/2005 |
| JP | 2005-343667 | 12/2005 |

OTHER PUBLICATIONS

Office Action for Japanese Application No. 2006-175665, dated Apr. 15, 2008.

* cited by examiner

*Primary Examiner*—Patrick H Mackey
*Assistant Examiner*—Prasad V Gokhale
(74) *Attorney, Agent, or Firm*—Banner & Witcoff, Ltd.

(57) ABSTRACT

A sheet feeding apparatus for separating and feeding stacked sheets one by one, includes a separation roller which rotates and applies a feeding force to a sheet of stacked sheets, a friction member which opposes the separation roller and which applies friction against the feeding force, and a rotation speed controller which controls a rotation speed of the separation roller. The rotation speed of the separation roller varies between a first speed and a second speed. The separation roller rotates at the first speed when separating a first one of the stacked sheets. The separation roller rotates at the second speed when separating sheets after separating a predetermined number of the stacked sheets. The first speed is slower than the second speed.

2 Claims, 8 Drawing Sheets

SHEET FEEDING APPARATUS

CROSS-REFERENCE TO RELATED APPLICATION

This application claims priority from Japanese Patent Application No. 2006-175665 filed on Jun. 26, 2006, the entire subject matter of which is incorporated herein by reference.

TECHNICAL FIELD

Aspects of the present invention relate to a sheet feeding apparatus for feeding/supplying continuously sheet-like recording media such as documents and recording paper. The present invention is effectively applicable to an auto document feeder that automatically feeds a document continuously to an image reading window (platen) of a scanner and a paper feeder that feeds recording paper continuously to an image forming portion of a printer.

BACKGROUND

JP-A-2004-297780 discloses an auto document feeder for a scanner having a separation roller that is rotated while contacting an uppermost one of documents stacked vertically and a separation pad arranged to oppose to the separation roller.

The auto document feeder (referred to as "ADF" hereinafter) suffers from the following problem: When the ADF is operated in a condition that a large number of documents are loaded (set), a leading ends of initial several sheets (in particular a first sheet) of the automatically fed documents are likely to be bent (this defect is referred to as a "leading end folding" hereinafter).

Incidentally, JP-A-8-319037 discloses a device for feeding a sheet at a slow speed before separation of the sheet from the stacked sheets and feeding the sheet at a high speed after the separation of the sheet from the stacked sheets, in order to separate the stacked sheets one by one surely and feed the sheet at a high speed. However, since this device is featured by changing a feeding speed for a sheet before and after the separation, it is difficult for this device to solve the leading end folding occurring in separating the stacked sheets.

SUMMARY

Aspects of the present invention provide a sheet feeding apparatus which can prevent a leading end folding without increasing the size of the sheet feeding apparatus and slowing feeding speed or decreasing stackable number of the sheets of the sheet feeding apparatus.

DETAILED DESCRIPTION

General Overview

According to an aspect of the present invention, a sheet feeding apparatus for separating and feeding stacked sheets one by one, the sheet feeding apparatus includes: a separation roller which rotates and applies a feeding force to a sheet of stacked sheets, a friction member which opposes the separation roller and which applies friction against the feeding force, and a rotation speed controller which controls a rotation speed of the separation roller, wherein the rotation speed controller controls the rotation speed of the separation roller to vary between a first speed and a second speed, wherein the separation roller rotates at the first speed when separating a first one of the stacked sheets, wherein the separation roller rotates at the second speed when separating sheets after separating a predetermined number of the stacked sheets, and wherein the first speed is slower than the second speed.

According to another aspect of the present invention, a sheet feeding apparatus for separating and feeding stacked sheets one by one, the sheet feeding apparatus includes: a separation roller which is rotated while contacting a first surface of individual sheets of the stacked sheets, when positioned at an end of the stacked sheets in a stacked direction, to apply a feeding force thereto; a friction member which opposes the separation roller and which contacts a second, opposite surface of the individual sheets of the stacked sheets to apply a predetermined feeding resistance thereto; and a rotation speed controller which controls a rotation speed of the separation roller so that the rotation speed of the separation roller at a point in time at which the separation roller starts feeding a first one of the stacked sheets is slower than the rotation speed of the separation roller after a predetermined time has elapsed from the point in time.

According to still another aspect of the present invention, a sheet feeding apparatus includes: a tray on which sheets can be stacked, the sheets including a first set and a second, subsequent set; a separation roller and a friction member which cooperatively form a nip to separate and feed the sheets one by one from the tray; and a controller which controls the separation roller to rotate at a first rotational speed when the separation roller feeds each sheet of the first set and at a second rotational speed when the separation roller feeds each sheet of the second set, wherein the first rotational speed is slower than the second rotational speed.

<Illustrative Aspects>

Illustrative aspects of the present invention will be described in detail with reference to the accompanying drawings.

Figure 8A:
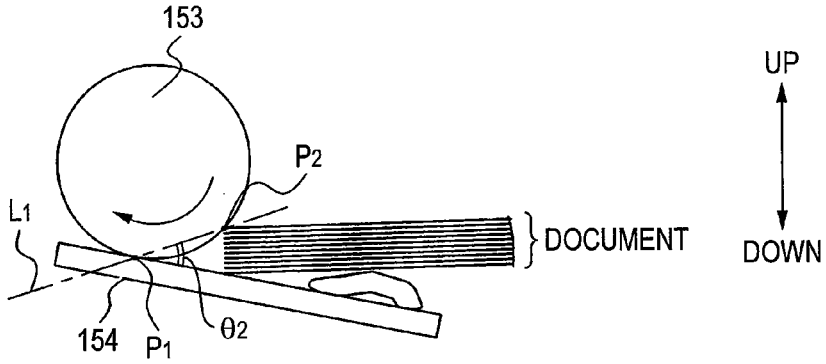
FIG. 8 is a schematic view to explain a normal operation of an ADF apparatus (when no leading end folding occurs).

FIGS. 8A to 8D are schematic view to explain a normal operation of the ADF apparatus in which no leading end folding occurs. More particularly, FIG. 8A shows a state that a separation roller 153 is at rest. When the separation roller 153 starts to rotate, the state of the loaded documents is changed in order of FIG. 8B→FIG. 8C→FIG. 8D.

Figure 8B:
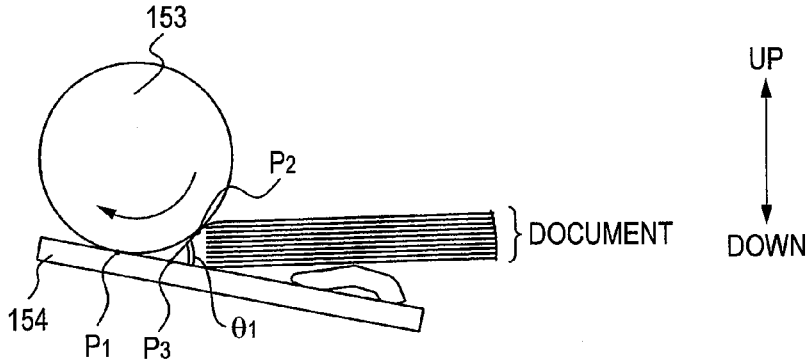
Figure 8C:
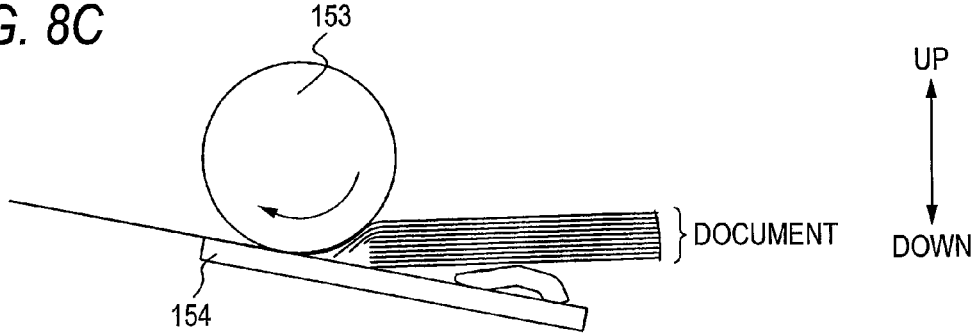

As shown in FIGS. 8B and 8C, when the separation roller 153 starts to rotate, the uppermost (first) one of the stacked documents receives a feeding force from the separation roller 153 in the tangential direction at a contact point of the first document with the separation roller 153, so that the first document abuts against the separation pad 154.

In this case, an abutting angle θ1 (see FIG. 8B) of the first document against the separation pad 154 is set below 90°. Therefore, the first document abutting against the separation pad 154 is directed toward a contact point (referred to as a "nip point P1" hereinafter) between the separation roller 153 and the separation pad 154, and the first document receiving the feeding force while being nipped between the separation roller 153 and the separation pad 154 is fed leftward of FIG. 8D.

During the course of this action, second and subsequent documents respectively contacting the first and preceding documents receive the feeding force indirectly through the first and preceding documents due to mutual surface friction, and thus are sequentially moved toward the nip point P1 as shown in FIG. 8C. Consequently, as shown in FIG. 8D, the leading ends of the stacked documents fill a space between the separation roller 153 and the separation pad 154 to present a wedge-shape (triangular shape) directed toward the nip point P1.

Figure 8D:
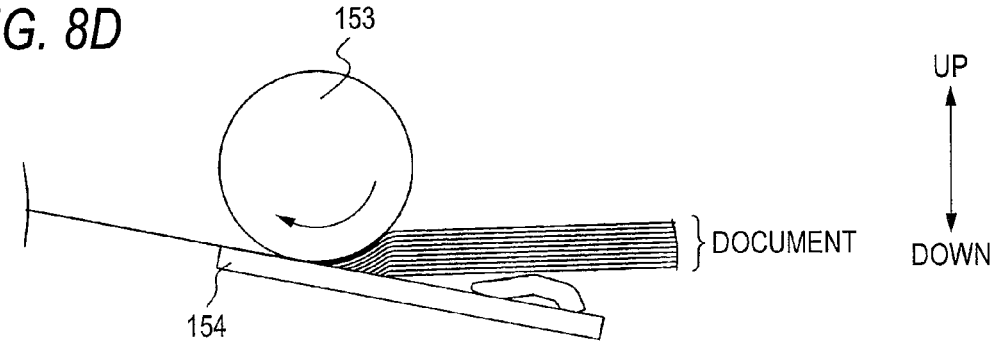

Of the stacked documents having such wedge-shape, the first document contacting the separation roller 153 and directly receiving the feeding force therefrom is fed leftward of FIG. 8D, whereas the second and subsequent documents receiving a feeding resistance from the separation pad 154 stay there, and are thus separated from the first document.

However, if a large number of documents are stacked, an angle θ2 of a reference line L1, which passes through the nip point P1 and the contact point P2 (see FIG. 8A) between the separation roller 153 and the first document, relative to the separation pad 154 is increased. This angle θ2 is referred to as a stack angle θ2 hereinafter. As the stack angle θ2 becomes larger, the abutting angle θ1 becomes larger.

As the abutting angle θ1 becomes larger, a force of component which can direct the first document toward the nip pint P1 when the first document abuts against the separation pad 154 becomes smaller, and also a friction force between the separation pad 154 and the first document becomes larger. Therefore, the leading end of the first document abutting against the separation pad 154 cannot be directed and moved toward the nip point P1 slidingly on and along the separation pad 154, so that the leading end folding occurs in the first document.

Namely, the leading end folding is most likely to occur when the first document is fed. In contrast, after the leading ends of the stacked sheets form the wedge-shape, the wedge-shaped leading ends act as a guide for guiding the document to be fed to the nip point P1, and therefore the leading end folding is hard to occur.

This problem can be eliminated by simply reducing the stack angle θ2 by a first solution in which the diameter of the separation roller 153 is increased, or by a second solution in which the number of the stacked documents is reduced. However, the first solution results in increase in size of the ADF, i.e., the sheet feeding apparatus, and the second solution results in decreased number of stackable sheets of the sheet feeding apparatus.

In order to increase an automatic feeding speed of the ADF, a rotation speed of the separation roller 153 has to be increased. However, if the rotation speed of the separation roller 153 is increased, the abutting force of the first document against the separation pad is increased to induce the leading end folding. That is, the leading end of the first document is buckled and folded at the time of the abutment.

This problem can be eliminated by decreasing the rotation speed of the separation roller 153 to such an extent that the leading end folding does not occur. However, this solution results in slowed feeding speed of the sheet feeding apparatus.

Aspects of the present invention provide a sheet feeding apparatus which can prevent a leading end folding without increasing the size of the sheet feeding apparatus and slowing the feeding speed of the sheet feeding apparatus.

First Example

In a first example, aspects of the present invention are applied to a multi functional apparatus in which an image reading apparatus, such as a scanner, having both an automatic feeding/reading function for reading an image on a document while feeding the document automatically and a flatbed reading function for reading an image on a document placed on a plate stationary and an image forming apparatus, such as a laser printer, are integrated together. In particular, in the first example, aspects of the present invention are applied to an auto document feeder apparatus to implement the automatic feeding/reading function to the multi functional apparatus.

1. Schematic Configuration of Multi Functional Apparatus 1

Figure 1:
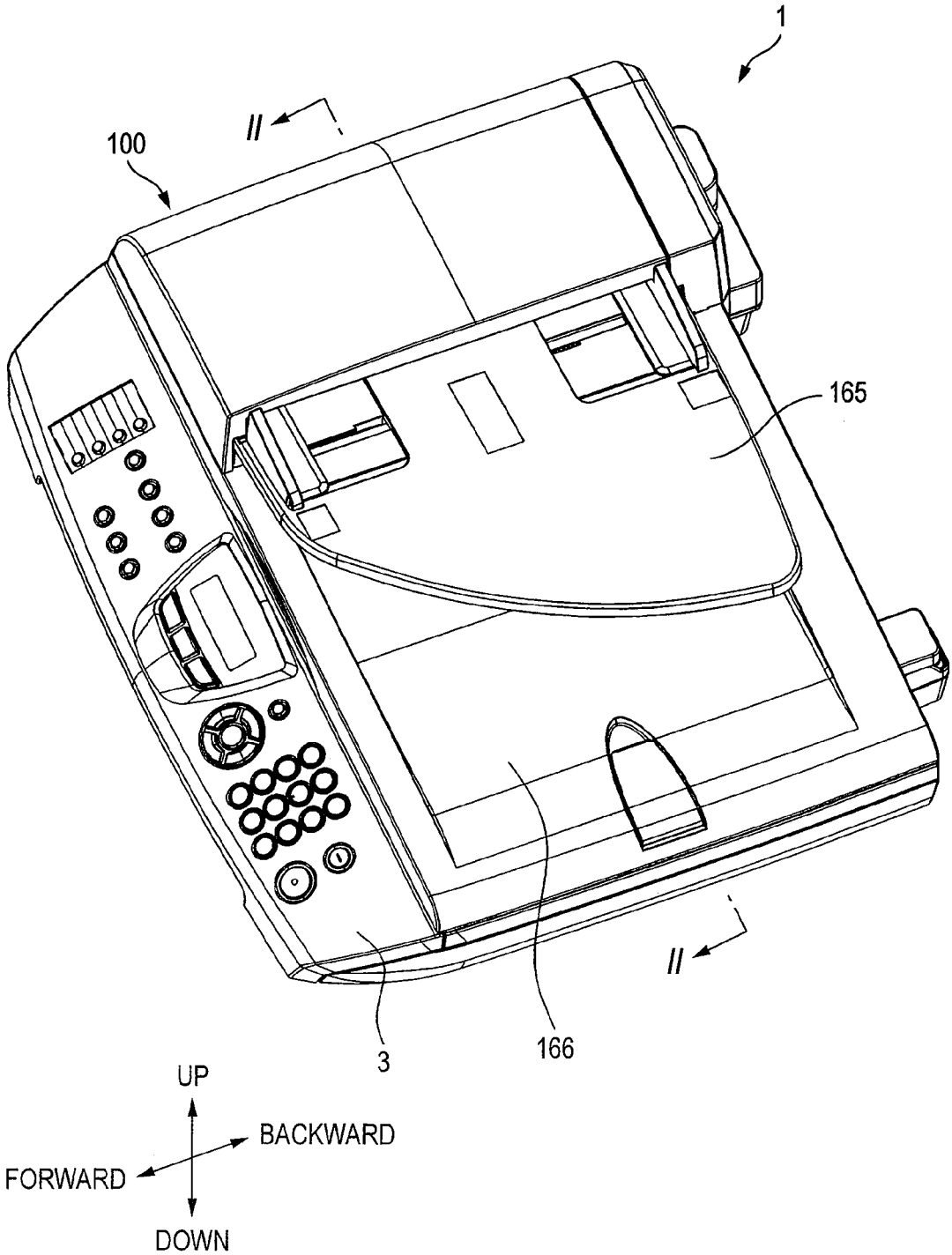
FIG. 1 is an external perspective view showing a multi functional apparatus according to a first example of the present invention when viewed from the top surface side.
Figure 2:
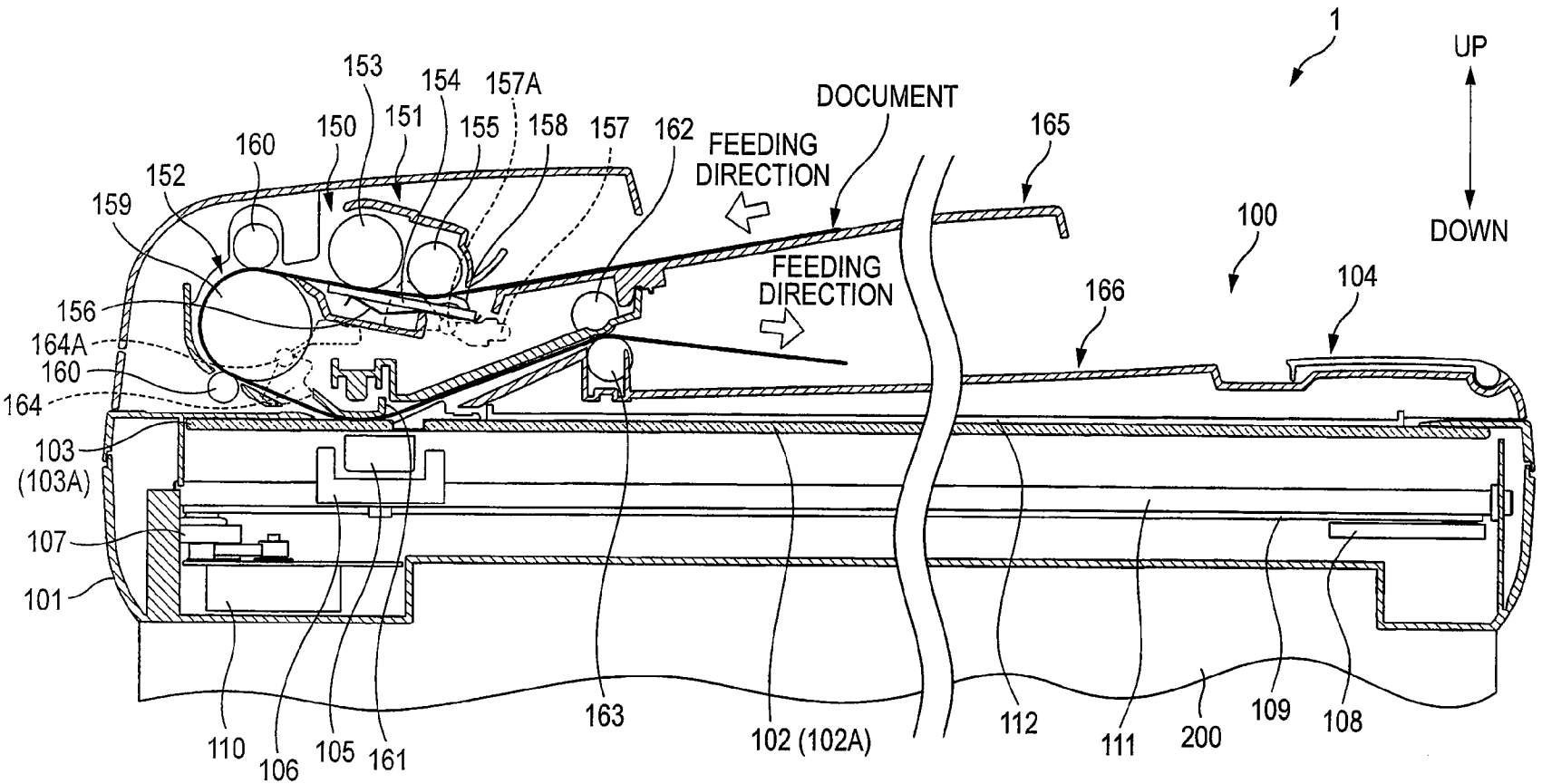
FIG. 2 is a sectional view taken along a II-II line of FIG. 1.

FIG. 1 is an external perspective view showing a multi functional apparatus 1 according to the first example as viewed from the top surface side, and FIG. 2 is a sectional view taken along a II-II line of FIG. 1.

As shown in FIG. 2, the multi functional apparatus 1 includes an image reading apparatus 100 in the upper side and an image forming apparatus 200 in the lower side. As shown in FIG. 1, the multi functional apparatus 1 has an operation panel portion 3 on the upper front surface thereof for operating/setting the multi functional apparatus 1.

2. Schematic Configuration of Image Reading Apparatus

As shown in FIG. 2, an image reading window 102 for the flatbed reading function (referred to as a "flatbed window" hereinafter) and an image reading window 103 for the automatic feeding/reading function (referred to as an "automatic reading window" hereinafter) are provided to a main body portion 101 of the image reading apparatus 100. Both reading window 102, 103 are closed by transparent plates 102A, 103A made of glass, acrylic resin, or the like.

A document cover 104 is swingably coupled to the upper surface side of the main body portion 101 for covering both the reading windows 102 and 103. When a document is to be read through the flatbed window 102, the document cover 104 is manually opened upward and the document is placed on the flatbed window 102.

An imaging device 105 is disposed within the main body portion 101 for receiving a light irradiated and reflected from the document generating an electric signal based on the received light. The image reading apparatus 100 reads the image by converting the image on the documents, such as the characters, into the electric signal via the imaging device 105.

In the present example, a CIS (Contact Image Sensor) is employed as the imaging device 105. The longitudinal direction of the CIS (imaging device 105) is orthogonal to a movable direction of the CIS. That is, the CIS is elongated in a direction perpendicular to a surface of FIG. 2 under the reading windows 102 and 103.

The imaging device 105 is movably coupled to the main body portion 101 via a carriage 106 in the longitudinal direction of the main body portion 101 (the lateral direction of FIG. 2). The imaging device 105 stays below the automatic reading window 103 to read an image under the automatic feeding/reading function. The imaging device 105 is moved along the flatbed window 102 to read an image under the flatbed reading function.

In the present example, the carriage 106 is coupled to a belt 109 suspended between a drive pulley 107 and an idle pulley 108. The carriage 106 (imaging device 105) is moved via the belt 109 by rotation of an electric motor 110 while being guided by a guide shaft 111.

A stationary document presser 112 is provided to a portion of the document cover 104 opposing to the flatbed window 102 for pressing the document put on the flatbed window 102 against the flatbed window 102. The stationary document presser 112 is swingably movable together with the document cover 104 relative to the main body portion 101 (flatbed window 102).

An auto document feeder apparatus (referred to as an "ADF apparatus" hereinafter) is disposed at a portion of the document cover 104 opposing to the automatic reading window 103 and its neighborhood. The ADF has an automatic document feeding mechanism 150 for feeding a document(s) to be read, to the automatic reading window 103.

3. ADF Apparatus 3.1. Mechanical Configuration of ADF Apparatus

The document(s) to be read under the automatic reading function is placed on a document tray 165. The documents stacked on the document tray 165 are fed to the automatic reading window 103 by the automatic document feeding mechanism 150, and then ejected on an eject tray 166.

The automatic document feeding mechanism 150 includes a separating mechanism 151 for separating the stacked documents one sheet by one sheet and a feeding mechanism 152 for feeding the document separated by the separating mechanism 151 to the automatic reading window 103.

The separating mechanism 151 includes a separation roller 153, a separation pad 154 and a pull-in roller 155. The separation roller 153 applies a feeding force to an uppermost one of the vertically stacked documents. The separation pad 154, which is an example of a friction member, is arranged to oppose to the separation roller 153, and contacts the documents to apply a predetermined friction to the document. That is, the separation roller 153 contacts a surface of the document to apply the friction against the feeding force thereto and the separation pad 154 contacts an opposite surface of the document to apply the feeding resistance thereto. The pull-in roller 155 pulls-in and pushes the stacked documents on the document tray 165 to the separation roller 153. To receive the stacked documents, the pull-in roller 155 is movable in a vertical direction, and is urged downward by an elastic member such as a spring.

A separation pad presser 156 serves to press the separation pad 154 toward the separation roller 153. The separation pad presser 156 is constructed by a leaf spring that is bent at a middle thereof to present a substantially "V" shape.

A first document sensor actuator 157 serves to sense whether or not the stacked documents are fed to the separation roller 153 by the pull-in roller 155. A document guide plate 158 serves to guide the stacked documents to the pull-in roller 155 and the separation roller 153 when the stacked documents are slidingly moved downward from the document tray 165 by the action of the gravity.

The first document sensor actuator 157 is coupled to the document cover 104 swingably about a swinging fulcrum 157A. When the documents are not fed (that is, no document is present in the vicinity of the separation roller 153), the first document sensor actuator 157 takes a position indicated by a broken line in FIG. 2, and is put into an OFF state. During the feeding of the documents, the first document sensor actuator 157 is pushed and swung by the documents counterclockwise about the fulcrum 157A from the state indicated by the broken line, and outputs an ON signal.

The feeding mechanism 152 includes a feed roller 159 for applying a feeding force to the document, separated by the separating mechanism 151, while turning the feeding direction of the document toward the automatic reading window 103, and a pair of pinch rollers 160 for pressing the document against the feed roller 159.

A document presser 161 presses the document, fed from the automatic document feeding mechanism 150, against the automatic reading window 103. An eject roller 162 serves to eject the document to the eject tray 166 after reading of the image on the document is complete. A pinch roller 163 pushes the document against the eject roller 162.

A second document sensor actuator 164 is arranged at the downstream side of the separating mechanism 151 in the document feeding direction, and serves to sense whether or not the document has passed therethrough. When the document is passing through the second document sensor actuator 164, the second document sensor actuator 164 is pushed and swung by the document counterclockwise about a swinging fulcrum 164A from a state indicated by a broken line in FIG. 2, and outputs an ON signal. When no document is present at the second document sensor actuator 164, the second document sensor actuator 164 takes a position indicated by the broken line, and is put into an OFF state.

Figure 3:
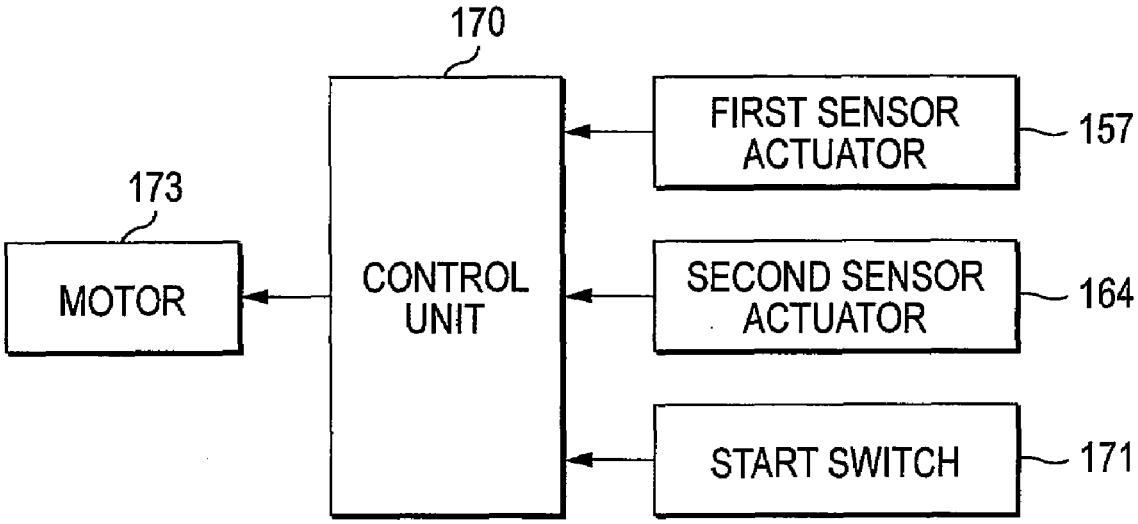
FIG. 3 is a block diagram showing an electrical configuration of an ADF apparatus according to the first example of the present invention.

FIG. 3 is a block diagram showing an electrical configuration of the ADF apparatus. Output signals of the first document sensor actuator 157 and the second document sensor actuator 164, an output signal of a start switch 171 provided to the operation panel portion 3 for the image reading apparatus 100, and the like are input into a control unit 170 including CPU, ROM and RAM.

The control unit 170, which is an example of a rotation speed controller, controls a rotation speed of an electric motor 173 for rotatingly driving the separation roller 153, and the like, based on these output signals. In the present example, the pull-in roller 155, the separation roller 153, the feed roller 159, and the eject roller 162 are mechanically linked via a gear mechanism (not shown) to rotate in synchronism with each other. Therefore, when a rotation speed of the separation roller 153 is changed, rotation speeds of the pull-in roller 155 and the like are also changed correspondingly.

3.2 Operation of ADF Apparatus

When the pull-in roller 155 and the separation roller 153 start rotating, the feed roller 159 and the eject roller 162 also start rotating correspondingly. A document to which the feeding force is applied by the separation roller 153 (this document is referred to as a "first document" hereinafter) is fed toward the feed roller 159.

A second document contacting the first document, and subsequent documents attempt to move toward the feed roller 159 together with the first document due to mutual surface friction generated on contact surfaces of these documents. However, because of the feeding resistance from the separation pad 154 to the second and subsequent documents, the first document is separated from the second and subsequent documents and only the first document is fed toward the feed roller 159.

Figure 4:
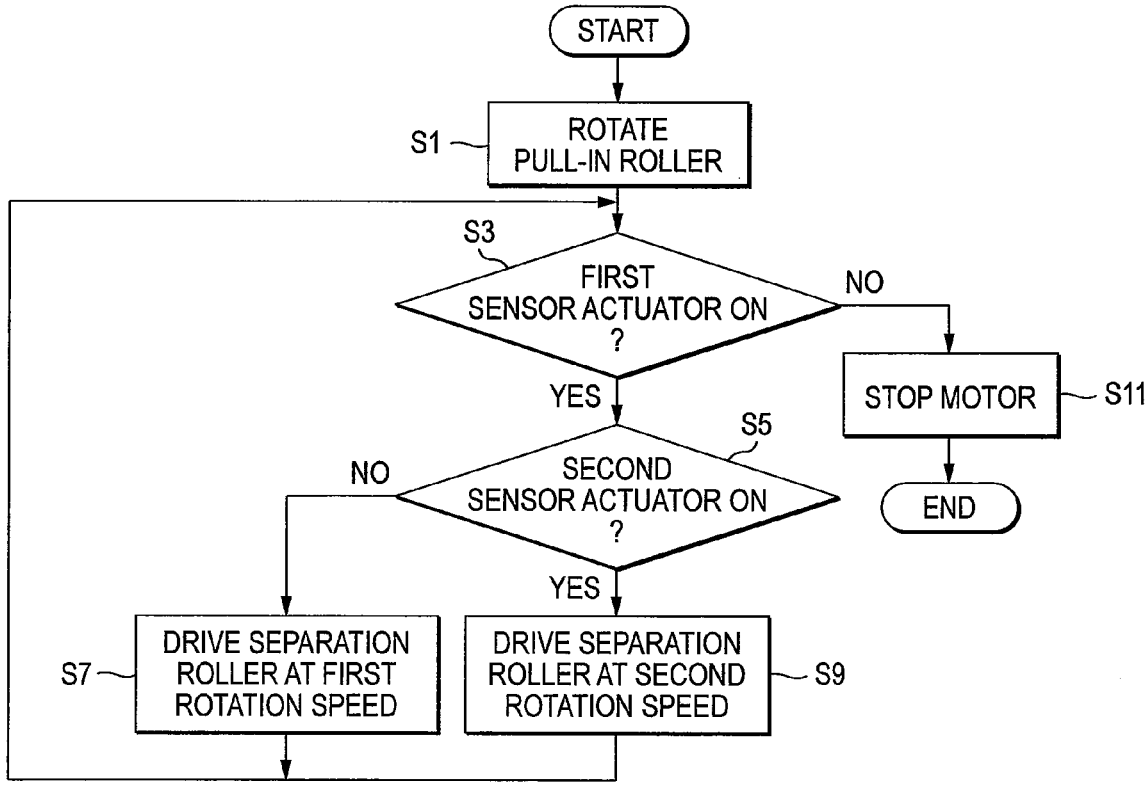
FIG. 4 is a flowchart showing control of a rotation speed of a separation roller according to the first example of the present invention.

FIG. 4 is a flowchart showing control of a rotation speed of the separation roller 153. When a start switch 171 is turned ON, the pull-in roller 155 start to rotate (S1). Then, it is decided whether or not the ON signal is output from the first document sensor actuator 157 (S3). If it is decided that the ON signal is not output from the first document sensor actuator 157 (S3: NO), the electric motor 173 for rotatingly driving the pull-in roller 155, the separation roller 153, etc. is stopped (S11). Then, the ADF apparatus is stopped.

If it is decided that the ON signal is output from the first document sensor actuator 157 (S3: YES), it is decided whether or not the ON signal is output from the second document sensor actuator 164 (S5). If it is decided that the ON signal is not output from the second document sensor actuator 164 (S5: NO), a rotation speed of the separation roller 153 is set to a first rotation speed V1 (S7). Then, the process in S3 is executed again.

If it is decided that the ON signal is output from the second document sensor actuator 164 (S5: YES), a rotation speed of the separation roller 153 is set to a second rotation speed V2 higher than the first rotation speed V1 (S9). Then, the process in S3 is executed again.

Figure 5:
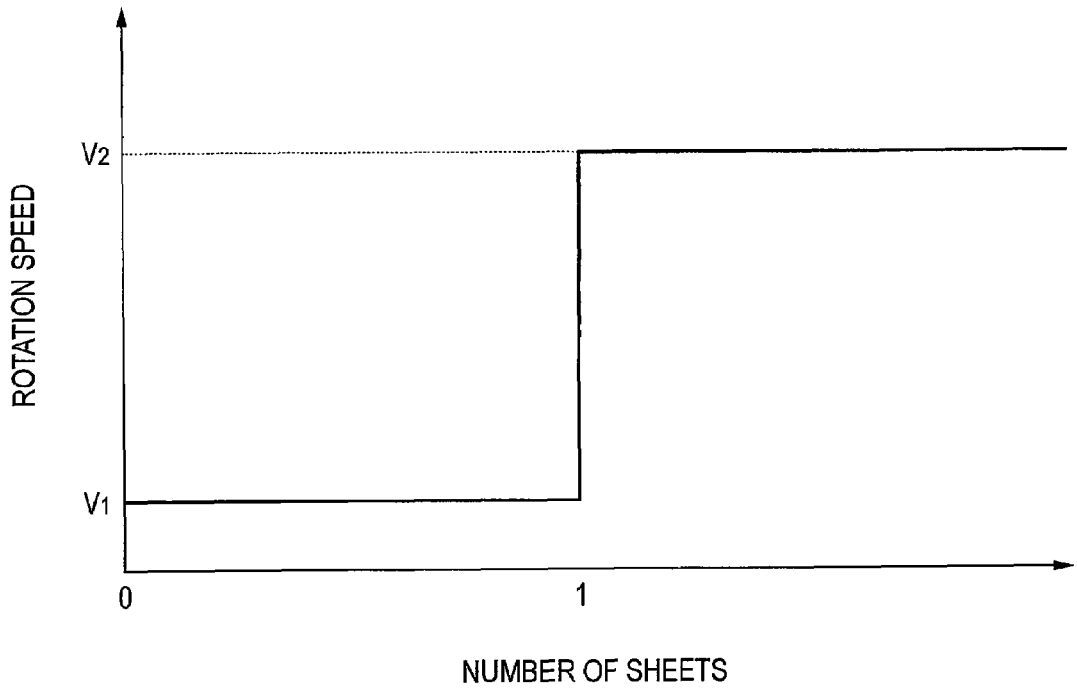
FIG. 5 is a graph showing a relationship between the rotation speed of the separation roller and the number of fed document.

Accordingly, as shown in FIG. 5, the separation roller 153 is rotatingly driven at the first rotation speed V1 until the first document is fed, i.e., the ON signal is output from the second document sensor actuator 164, after the automatic continuous feeding is started (the start switch 171 is turned ON). The separation roller 153 is rotatingly driven at the second rotation speed V2 higher than the first rotation speed V1 after the leading end of the first document is ejected from the separating mechanism 151.

Therefore, a rotation speed of the separation roller 153 for feeding the first document is set smaller than a rotation speed of the separation roller 153 for feeding the second and subsequent documents. Therefore, an abutting force generated when the first document abuts against the separation pad 154 can be reduced.

Accordingly, the leading end folding can be prevented from occurring in the first document without the use of solutions of increasing a size of the separation roller 153 and reducing the number of the stacked documents.

The leading ends of the stacked documents are brought into a wedge-shape when the first document is fed. Therefore, after the first document is fed without the leading end folding, a chance of the leading end folding in second and subsequent documents is extremely low as discussed above.

A rotation speed of the separation roller 153 is increased after the leading end of the first document is ejected from the separating mechanism 151. Therefore, a high feeding speed of the ADF apparatus can be ensured while eliminating the leading end folding.

As described above, the ADF apparatus according to present example can eliminate the leading end folding without increasing the size of the ADF apparatus and slowing feeding speed or decreasing stackable number of the sheets of the sheet feeding apparatus.

Second Example

In the first example, the second document sensor actuator 164 decides whether or not the document is fed by a predetermined number of sheets (in the above example, one sheet, i.e. the first document) after the ADF apparatus starts to operate, and when it is decided that the document is fed by the predetermined number of sheets, a rotation speed of the separation roller 153 is increased. The second example dispenses with the second document sensor actuator 164, and instead of counting a predetermined number of fed documents using the actuator 164, the second example measures a predetermined time (duration) from a time point at which the feeding of the documents is started. That is, if the predetermined time has elapsed since the automatic feeding of the first document was started, i.e., the ON signal was output from the first document sensor actuator 157, then the second example regards such that the predetermined number of documents would be fed, and thus increases a rotation speed of the separation roller 153.

Details of the operation and the technical feature of the ADF apparatus according to the second example will be explained hereunder.

Figure 6:
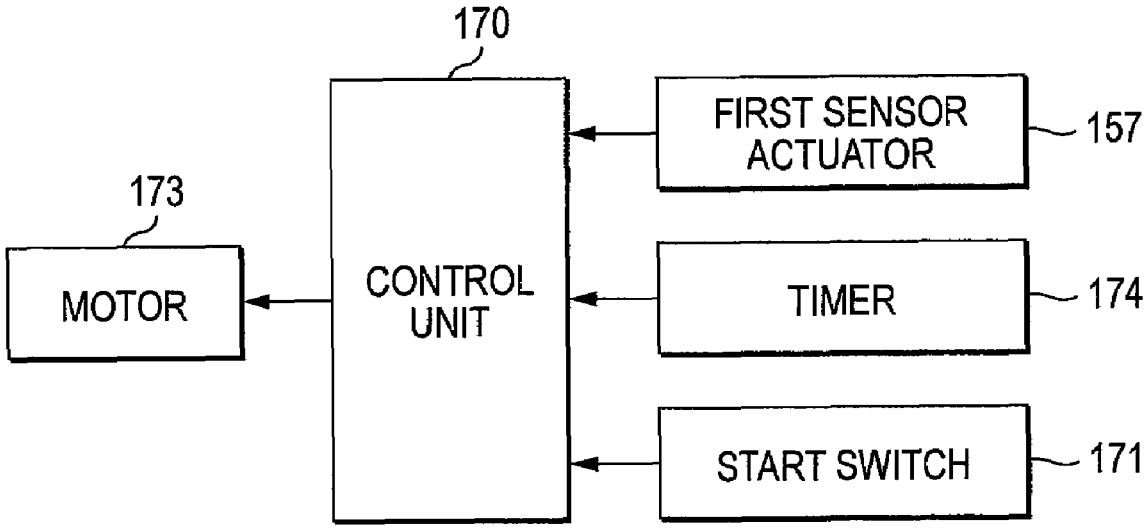
FIG. 6 is a block diagram showing an electrical configuration of an ADF apparatus according to a second example of the present invention.

FIG. 6 is a block diagram showing an electrical configuration of the ADF apparatus according to the second example. As shown in FIG. 6, the ADF apparatus includes a timer 174 for counting a time in place of the second document sensor actuator 164.

Figure 7:
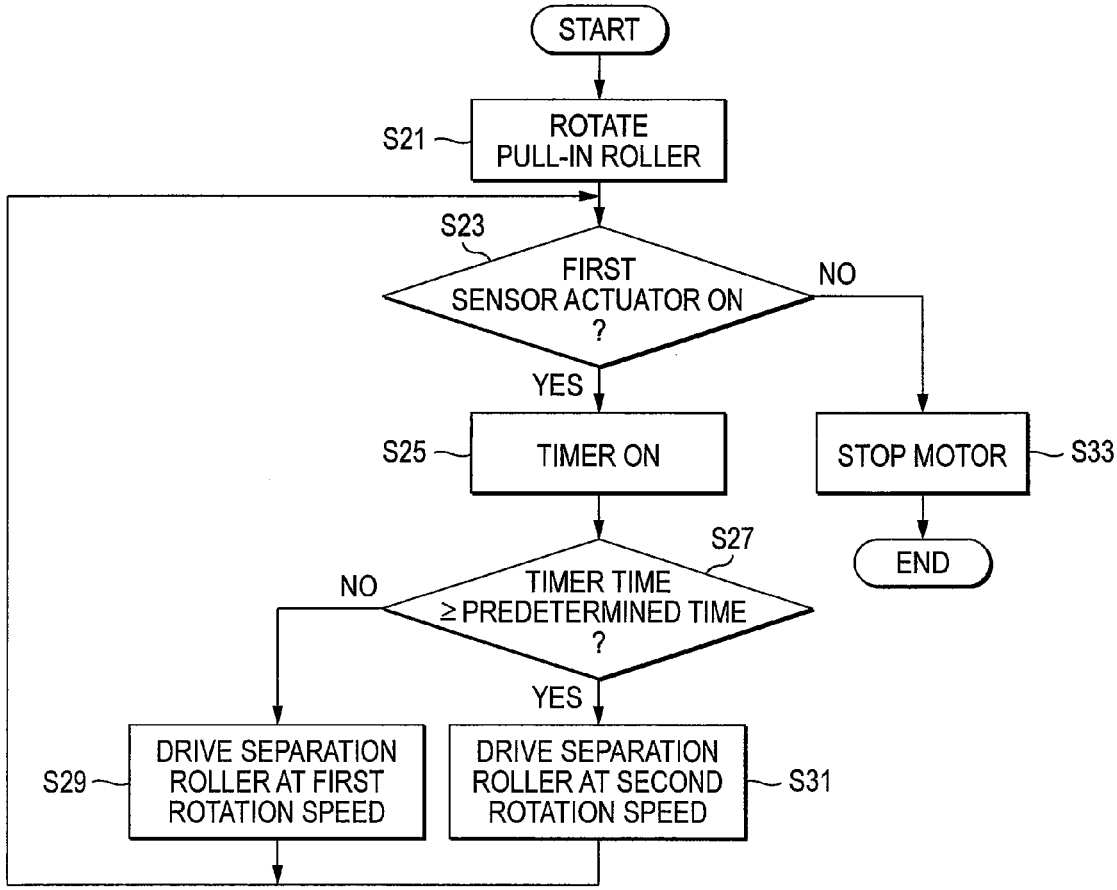
FIG. 7 is a flowchart showing control of a rotation speed of a separation roller according to the second example of the present invention.

FIG. 7 is a flowchart showing control of a rotation speed of the separation roller 153 in the ADF apparatus. First, the start switch 171 is turned ON and the pull-in roller 155 starts to rotate (S21). Then, it is decided whether or not the ON signal is output from the first document sensor actuator 157 (S23). If it is decided that the ON signal is not output from the first document sensor actuator 157 (S3: NO), the electric motor 173 for rotatingly driving the pull-in roller 155 and the separation roller 153 is stopped (S33). Then, the ADF apparatus is stopped.

If it is decided that the ON signal is output from the first document sensor actuator 157 (S3: YES), the timer 174 is started to count a time (S25). Then, it is decided whether or not the time counted by the timer 174 (timer time) exceeds a predetermined time (S27).

In the second example, a time required to fed the first document after the ON signal is output from the first document sensor actuator 157 is set as the predetermined time.

If it is decided that the timer time does not exceed the predetermined time (S27: NO), a rotation speed of the separation roller 153 is set to the first rotation speed V1 (S29). Then, the process in S23 is executed again. If it is decided that the timer time exceeds the predetermined time (S27: YES), a rotation speed of the separation roller 153 is set to the second rotation speed V2 (S31). Then, the process in S23 is executed again.

Accordingly, in the ADF apparatus according to the second example, a rotation speed of the separation roller 153 from a time point at which the ON signal is output from the first document sensor actuator 157 to a time point at which a predetermined time elapses thereafter is set smaller than a rotation speed of the separation roller 153 after the predetermined time elapses. Therefore, an abutting force of the first document abutting against the separation pad 154 can be reduced.

Consequently, without the use of disadvantageous solutions of increasing a size of the separation roller 153 and reducing the number of stacked documents, it is possible to eliminate the leading end folding from a time point at which the feeding of the first document is started to a time point at which a predetermined time elapses thereafter.

Further, since the leading ends of the stacked documents are brought into a wedge-shape stacked state at or prior to the time point at which the predetermined time elapses after the start of the feeding of the first document. Therefore, as far as the leading end folding does not occur during the predetermined time, it is hardly possible that the leading end folding will be caused thereafter, as described above.

The rotation speed of the separation roller 153 is increased after the predetermined time elapses. Therefore, a feeding speed of the ADF apparatus is prevented from being reduced largely.

As described above, the ADF apparatus according to second example can eliminate the leading end folding without increasing the size of the ADF apparatus and slowing feeding speed or decreasing stackable number of the sheets of the sheet feeding apparatus.

Other Examples

In the above examples, the sheet feeding apparatus according to the present invention is applied to the ADF apparatus, but the present invention is not limited thereto or thereby. The present invention can be applied to a paper feeder for feeding recording paper continuously to an image forming apparatus of a printer, a counting mechanism for counting sheet-like members, and the like.

In the above examples, a rotation speed of the separation roller 153 is reduced until a predetermined number of documents is fed after the automatic feeding of the documents is started or until a time required for feeding a predetermined number of documents elapses. But the present invention is not limited thereto or thereby. A timing (a predetermined number of documents or a time corresponding to the predetermined number of documents) at which a rotation speed of the separation roller 153 is changed may be varied based on a paper quality of the document, a weighting of the document, or the like.

In the above examples, irrespective of the number of documents stacked and loaded on the document tray 165, a rotation speed of the separation roller 153 is reduced until a predetermined number of documents is fed after the start of the automatic feeding of documents or until a time required for feeding a predetermined number of documents elapses. But the present invention is not limited thereto or thereby. For example, the rotation speed of the separation roller 153 may be changed depending on the number of documents stacked on the document tray 165. For example, the rotation speed of the separation roller 153 may be controlled such that if the number of documents stacked on the document tray 165 exceeds a predetermined number, the rotation speed of the separation roller 153 is changed to increase when the number of fed documents arrives at the predetermined number or an elapsed time reaches a predetermined time corresponding to the feeding of the predetermined number of documents. If the number of documents stacked on the document tray 165 is below the predetermined number, a rotation speed of the separation roller 153 is not changed to be constant.

In the above examples, a timing (a predetermined number of documents or a time corresponding to the predetermined number of documents) at which a rotation speed of the separation roller 153 is changed is preliminarily set as a fixed value. But the present invention is not limited thereto or thereby. A setting inputting means may be provided to enable a user to input and set a desired timing at which the user desires to change a rotation speed of the separation roller 153.

In the above examples, a rotation speed of the separation roller 153 is changed in two steps of the first rotation speed V1 and the second rotation speed V2. But the present invention is not limited thereto or thereby. A rotation speed of the separation roller 153 may be varied in three steps or may be varied in a stepless manner from the first rotation speed V1 to the second rotation speed V2.

In the above examples, the documents are stacked vertically. But the present invention is not limited thereto or thereby. In addition, a document (or a sheet) positioned at an end of stacked documents (or stacked sheets) in a stacked direction means a document to be first fed from among the stacked documents.

Aspects of the present invention are not limited to the above and may be embodied in various other ways without departing from a scope of the invention.

What is claimed is:

1. A sheet feeding apparatus for separating and feeding stacked sheets one by one, the sheet feeding apparatus comprising:

a separation roller which is rotated while contacting a first surface of individual sheets of the stacked sheets, when positioned at an end of the stacked sheets in a stacked direction, to apply a feeding force thereto;

a friction member which opposes the separation roller and which contacts a second, opposite surface of the individual sheets of the stacked sheets to apply a predetermined feeding resistance thereto; and a rotation speed controller which controls a rotation speed of the separation roller so that the rotation speed of the separation roller at a point in time at which the separation roller starts feeding a first one of the stacked sheets is slower than the rotation speed of the separation roller after a predetermined time has elapsed from the point in time.

2. A sheet feeding apparatus comprising:

a tray on which sheets can be stacked, the sheets including a first set and a second, subsequent set;

a separation roller and a friction member which cooperatively form a nip to separate and feed the sheets one by one from the tray;

a controller which controls the separation roller to rotate at a first rotational speed when the separation roller feeds each sheet of the first set and at a second rotational speed when the separation roller feeds each sheet of the second set, and a counter which counts a number of sheets fed by the separation roller, wherein the first rotational speed is slower than the second rotational speed; and wherein when the number counted by the counter reaches a predetermined value, the controller changes the rotational speed of the separation roller from the first rotational speed to the second rotational speed.

* * * * *